United States Patent [19]

Sneeringer

[11] 4,315,374

[45] Feb. 16, 1982

[54] BASEBALL SHOE

[76] Inventor: Andrew M. Sneeringer, 529 Main St., McSherrystown, Pa. 17344

[21] Appl. No.: 155,566

[22] Filed: Jun. 2, 1980

[51] Int. Cl.[3] ..... A43B 5/00; A43B 23/28; A43C 15/00

[52] U.S. Cl. ..... 36/126; 36/59 R; 36/67 D

[58] Field of Search ..... 36/126, 67 R, 67 D, 36/67 B, 59 R, 127, 128, 129

[56] References Cited

U.S. PATENT DOCUMENTS

| | | | |
|---|---|---|---|
| 1,867,219 | 7/1932 | Harper | 36/126 |
| 3,040,450 | 6/1962 | Phillips | 36/126 |
| 4,107,858 | 8/1978 | Bowerman et al. | 36/67 R |
| 4,194,310 | 3/1980 | Bowerman | 36/59 R |

*Primary Examiner*—Patrick D. Lawson
*Attorney, Agent, or Firm*—C. Hercus Just

[57] ABSTRACT

A baseball shoe comprised of an upper shoe body, a unitary molded sole and heel affixed to the bottom of said body, metal blade-like spikes projecting from said sole in triangular pattern, and a cluster of blunt plug-like cleats molded integrally with said heel and adapted to be relatively noninjurious to peronnel or base bags when engaged by said cleats.

3 Claims, 2 Drawing Figures

BASEBALL SHOE

BACKGROUND OF THE INVENTION

For many years, baseball shoes have used metal cleats or spikes of blade-like nature, both on the soles and heels of the shoes. In general, said spikes have been arranged respectively on said soles and heels in triangular fashion. The spikes on the soles of the shoe are generally located so that at least a pair of the triangular pattern of spikes are adjacent the ball of a foot when in the shoe and all three of the spikes of said pattern are intended for effective gripping of the ground surface, especially when running between bases or in the field.

The cleats on the heel also are effective and necessary to give good footing, especially when batting, to prevent slipping of the feet but, in many instances, the blade-like metal spikes on the heel of baseball shoes are somewhat lethal to personnel and also damaging to physical property, such as base bags, especially when a player is sliding into a base, heel first in order to tag the bag before the player can be tagged by an opposing player. Quite frequently, the metal spikes conventionally employed on baseball shoes tend to become sharpened at the edge and actually have cutting capacity and many baseball players have been badly injured by cutting when engaged in a close play by a runner sliding into a base contacting the leg or foot of the baseman and, similarly, baseball bags conventionally are covered with canvas and the sharp heel spikes in particular, when engaging said canvas, have a tendency to rip the same.

To obviate the foregoing, the present invention provides a mixture of different types of ground-engaging spikes or cleats described in detail hereinafter, the components thereof which are used in combination individually are known in the prior art, but not in such combination. For example, plug-like cleats are well known in football shoes and are employed both on the forward portion of the sole of a football shoe, as well as on the heel thereof. Frequently, only relatively few are used on the heels, such as of the order of two or three, but a greater number are used on the sole of the football shoe.

Presumably for purposes of economy, interchangeable type ground-engaging elements have been provided heretofore and comprise the subject matter of prior U.S. Pat. Nos. 3,442,033 to Hilburn, Jr., dated May 6, 1969, and 3,526,976 to Jacobs, dated Sept. 8, 1970. In these patents, sets of either baseball or football cleats or spikes are proposed, the same being interchangeable in suitable sockets formed in the sole and heel of the sports shoe, but a mixture of the same is not suggested.

Similarly, a mixture of plug-like cleats on the heel and different configurations of non-sharp ground-engaging members on the sole thereof comprise the subject matter of prior U.S. Pat. No. 2,678,507 to Dye, dated May 18, 1954. None of the foregoing patents suggest the possibility of a mixture of metal spikes and cleats with relatively blunt plug-like shapes respectively on the soles and heels of an athletic shoe, particularly adapted for baseball use, as in the present invention, details of which are set forth below.

SUMMARY OF THE INVENTION

It is the principal object of the invention to preserve the ground-gripping effect of metal blade-like cleats arranged preferably in triangular configuration on the sole of a baseball shoe, while substituting for the conventional blade-like metal cleats of a normal baseball shoe, a cluster of plug-like blunt cleats integrally affixed to the heel of the baseball shoe for purposes of minimizing, if not eliminating the possibility of serious injury inflicted by such plug-like cleats, in the event they contact either human personnel or equipment, such as base bags.

Another object of the invention is to form the unitary sole and heel of a baseball shoe from molded synthetic resin or plastic material having limited flexibility corresponding approximately to that afforded by conventional leather when used in similar shoes.

A further object of the invention is to mount the metal blade-like spikes on the sole of the shoe by imbedding within the sole material, when molded, a metal base plate from which the blade-like spikes are bent to be perpendicular thereto and project through the molded material of the sole in perpendicular manner while the metal base member is effectively secured within the molded sole to prevent accidental tearing of the same therefrom.

Details of the foregoing objects and of the invention, as well as other objects thereof are set forth in the following specification and illustrated in the accompanying drawing comprising a part thereof.

DETAILED DESCRIPTION OF THE PREFERRED EMBODIMENT

Figure 1:
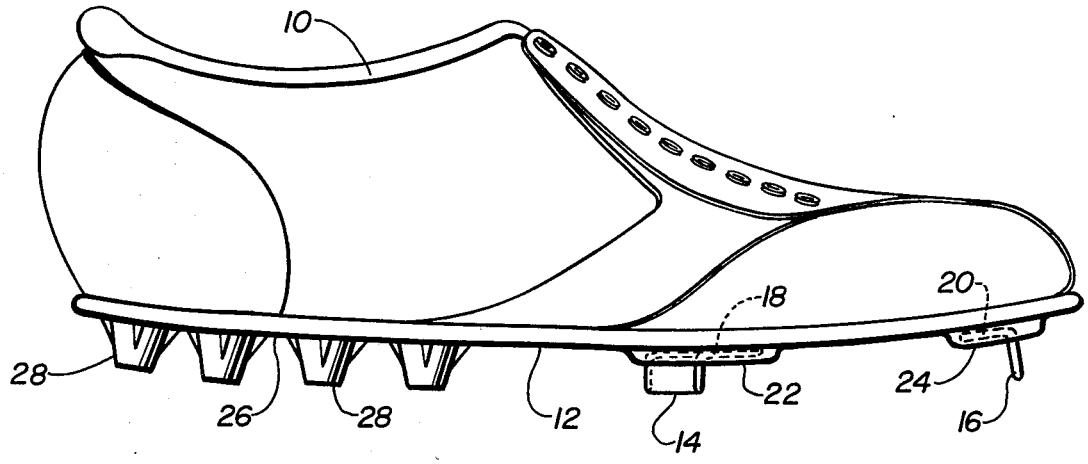
FIG. 1 is a side elevation of an exemplary baseball shoe embodying the principles of the present invention.

Referring to FIG. 1, a conventional upper shoe body 10 is shown, which may be made from conventional materials presently used, such as leather, combination of fabric and plastic material, or otherwise. Affixed to the bottom of the upper shoe body 10 is a unitary combination heel and sole 12, which preferably is formed from appropriate synthetic resin, plastic material of limited flexibility, such as that of the order of leather used in conventional shoes, primarily to permit the sole to flex in the area slightly forward of the instep of a human foot when disposed in the shoe.

Figure 2:
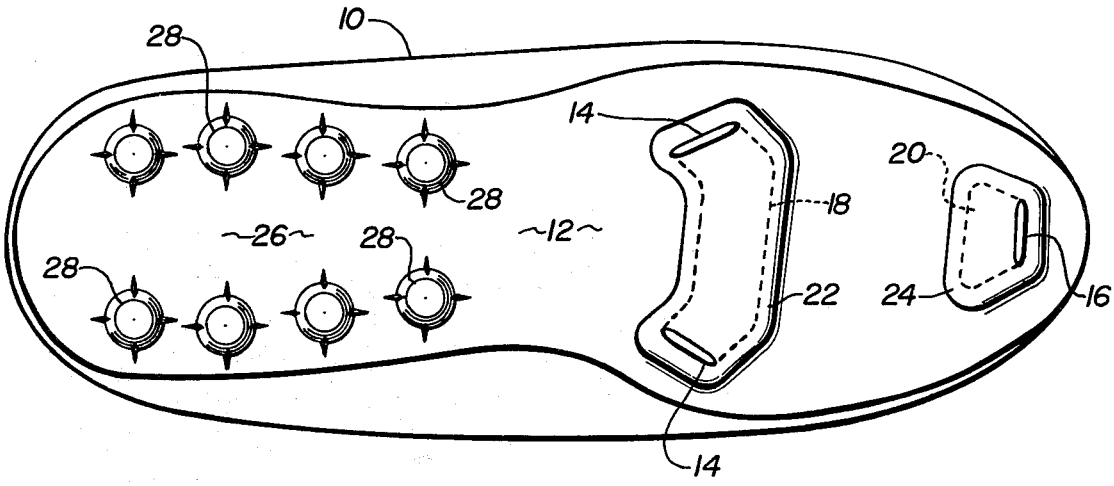
FIG. 2 is a bottom plan view of the shoe shown in FIG. 1 and illustrating the combination of different types of cleats and spikes comprising the invention.

Metal, blade-like cleats 14 and 16 project perpendicularly from metal base plate members 18 and 20, which are effectively attached to the combination heel and sole 12, by being imbedded within the plastic material from which the sole is formed and, as clearly shown in FIGS. 1 and 2, the plastic material which encloses the base plate members 18 and 20, covers the lower surfaces thereof adequately in the form of flat projections 22 and 24 which do not interfere with the operation of the blade-like spikes 14 and 16. Hence, the sole portion of the shoe forwardly of the instep provides the triangular arrangement of the blade-like cleats 14 and 16 of metal.

Referring to the heel portion 26 of the shoe, it will be seen that relatively blunt, plug-like cleats 28, preferably of uniform height and similar shape, are integrally molded with the plastic material from which the combination heel and sole 12 is formed, including the heel portion 26. As best seen in FIG. 1, the cleats 28 preferably are frusto-conical in side elevation, and referring to FIG. 2, it will be seen that a double row thereof is formed respectively adjacent opposite sides of the heel 26 and slightly curved to form a cluster thereof, readily capable of providing adequate ground-gripping ability while, nevertheless, not being sharp, especially in the event a player is sliding toward a base bag, heel first, if the cleats 28 happen to engage an opposing player on the foot or leg, or a base bag, no serious damage will be inflicted and the ground-gripping ability of the heel cleats is not sacrificed in any way.

From the foregoing, therefore, it will be seen that the dangerous possibilities of the heel spikes of a conventional baseball shoe have been eliminated and are replaced by relatively harmless plug-like blunt cleats of plastic material, providing highly capable ground-gripping ability, such as when a baseball player is at bat or standing adjacent a base bag, while the shoe also retains the ground-gripping ability on the sole of the shoe, especially in the area thereof opposite the ball of a foot to provide the very firm ground-gripping ability for running purposes afforded by metal blade-like spikes securely and integrally bonded to the plastic sole of the shoe.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A baseball shoe comprising in combination an upper shoe body, a unitary sole and heel molded from homogeneous material of limited flexibility similar to that of sole leather and affixed to the bottom of said body, metal base plate means enclosed within said sole and provided with integral metal blade-like spikes arranged in a triangular pattern with one spike near the outer tip of the sole and said spikes projecting perpendicularly from said base plate through said sole for ground-gripping when running to and from bases, and a cluster of blunt plug-like cleats molded integrally with said heel from the material of said sole and projecting therefrom in a pattern to afford ground-gripping capability in the heel area of the shoe but non-injurious to human personnel or base bags when sliding feet-first into a base bag, and said cluster of blunt plug-like cleats being in slightly curved rows disposed adjacent opposite sides of said heel.

2. The baseball shoe according to claim 1 in which said unitary sole and heel and blunt plug-like cleats are molded from plastic synthetic resinous material.

3. The baseball shoe according to claim 1 in which said sole of the shoe is provided with flat molded projections in which said metal base plate means are embedded to effectively mount said means within said sole.

* * * * *